US008598973B2

(12) United States Patent
Kawaguchi

(10) Patent No.: US 8,598,973 B2
(45) Date of Patent: Dec. 3, 2013

(54) REACTOR

(75) Inventor: Hajime Kawaguchi, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/266,974

(22) PCT Filed: Apr. 30, 2010

(86) PCT No.: PCT/JP2010/057656

§ 371 (c)(1),
(2), (4) Date: Oct. 28, 2011

(87) PCT Pub. No.: WO2010/128648

PCT Pub. Date: Nov. 11, 2010

(65) Prior Publication Data

US 2012/0044033 A1 Feb. 23, 2012

(30) Foreign Application Priority Data

May 7, 2009 (JP) ..... 2009-112675

(51) Int. Cl.
*H01F 27/30* (2006.01)
*H01F 17/04* (2006.01)

(52) U.S. Cl.
USPC ..... 336/199; 336/205; 336/208; 336/212

(58) Field of Classification Search
USPC ..... 336/178, 210, 212, 221, 199, 205, 208
See application file for complete search history.

(56) References Cited

U.S. PATENT DOCUMENTS 1,467,771 A * 9/1923 Alden ..... 336/155
1,763,114 A * 6/1930 Wermine ..... 336/84 R
(Continued)

FOREIGN PATENT DOCUMENTS

JP 11-144977 A 5/1999
JP 11144977 A * 5/1999
(Continued)

OTHER PUBLICATIONS

International Search Report issued in International Patent Application No. PCT/JP2010/057656, dated Aug. 10, 2010.
(Continued)

*Primary Examiner* — Mohamad Musleh
*Assistant Examiner* — Joselito Baisa
(74) *Attorney, Agent, or Firm* — McDermott Will & Emery LLP

(57) ABSTRACT

A reactor that is fabricated with high productivity is provided. The reactor 1 includes an annular magnetic core 11, a coil molded product 12A, and an external resin portion 13. The coil molded product 12A is disposed around an outer periphery of the magnetic core 11, the external resin portion 13 covers an outer periphery of an assembly 10 of the magnetic core 11 and the coil molded product 12A. The magnetic core 2 includes a plurality of core pieces that are combined so as to form an annular shape. The magnetic core 2 is fixed in the annular shape using the external resin portion 13 that covers the magnetic core without use of adhesive. The coil molded product 12A includes a coil 12 formed of a helically wound wire 12*w* and an internal resin portion 12*c* that maintains the coil 12 in a compressed state. Since the magnetic core 11 is formed without adhesive, a bonding step is not required. Due to use of the coil molded product 12A, the coil 12 needs not be compressed while forming the reactor 1. Thus, the reactor 1 is fabricated with high productivity.

4 Claims, 5 Drawing Sheets

(56) References Cited

U.S. PATENT DOCUMENTS

| | | | | |
|---|---|---|---|---|
| 3,169,234 | A * | 2/1965 | Renskers | 336/192 |
| 4,791,395 | A * | 12/1988 | Henderson, Sr. | 336/210 |
| 6,375,884 | B1 * | 4/2002 | Shikama et al. | 264/254 |
| 6,600,402 | B1 * | 7/2003 | LaFleur et al. | 336/61 |
| 6,653,924 | B2 * | 11/2003 | Vinciarelli et al. | 336/212 |
| 6,842,100 | B1 * | 1/2005 | Kim | 336/198 |
| 6,917,273 | B2 * | 7/2005 | Okamoto | 336/200 |
| 7,800,474 | B2 * | 9/2010 | Yabumi et al. | 336/110 |
| 8,253,524 | B2 * | 8/2012 | Nomura et al. | 336/208 |
| 2010/0194518 | A1 * | 8/2010 | Ritter et al. | 336/84 M |

FOREIGN PATENT DOCUMENTS

| | | | |
|---|---|---|---|
| JP | 2005-019764 | A | 1/2005 |
| JP | 2006-100513 | A | 4/2006 |
| JP | 2006-351679 | A | 12/2006 |
| JP | 2008-028288 | A | 2/2008 |
| JP | 2008-028290 | A | 2/2008 |
| JP | 2008-028313 | A | 2/2008 |
| JP | 2008-112856 | A | 5/2008 |
| JP | 2010-118611 | A | 5/2010 |

OTHER PUBLICATIONS

Chinese Office Action issued in Chinese Patent Application No. 201080019994.1, issued on Jan. 22, 2013, with English translation.

Chinese Office Action, w/ English translation thereof, issued in Chinese Patent Application No. 201080019994.1 dated Jun. 20, 2013.

Japanese Office Action, w/ English translation thereof, issued in Japanese Patent Application No. 2009-112675 dated Aug. 20, 2013.

* cited by examiner (I)

(II)

(III)

REACTOR

RELATED APPLICATIONS

This application is the U.S. National Phase under 35 U.S.C. §371 of International Application No. PCT/JP2010/057656, filed on Apr. 30, 2010, which in turn claims the benefit of Japanese Application No. 2009-112675, filed on May 7, 2009, the disclosures of which Applications are incorporated by reference herein.

TECHNICAL FIELD

The present invention relates to a reactor that includes a magnetic core that includes a plurality of core pieces, and in particular, relates to a reactor that is fabricated with high productivity.

BACKGROUND ART

A reactor is one of components in a circuit that boosts or lowers voltage. For example, Patent Literature 1 discloses a reactor that is used as a circuit component of a converter that is installed in a vehicle such as a hybrid vehicle. This reactor includes an annular-shaped magnetic core, a coil, a case and resin. The coil is disposed around an outer periphery of the magnetic core, the case houses an assembly of the magnetic core and the coil, and the resin, with which the case is filled, seals the assembly. A typical magnetic core includes a plurality of core pieces formed of a magnetic material and gap members formed of a non-magnetic material. In this structure, the core pieces and the gap members are bonded to each other using adhesive (0026 in Patent Literature 1). The magnetic core includes coil wound portions around which the coil is disposed and end cores around which the coil is not disposed. By disposing sleeve-like bobbins formed of an insulating material around the coil wound portions (0022 in Patent Literature 1), an insulation property between the magnetic core and the coil is improved. Furthermore, a pair of frame-like bobbins are arranged to clamp the coil from both ends of the coil so as to compress the coil. In order to maintain this compressed state, an assembly of the coil and the coil wound portions of the magnetic core is housed in a box-like inner case (FIG. 4 of Patent Literature 1).

In the above-described reactor, the sleeve-like bobbins and the coil having been separately fabricated are sequentially disposed around the outer peripheries of the coil wound portions. In this state, the coil wound portions are clamped using the frame-like bobbins and the end cores, and the coil wound portions and the end cores are bonded to each other using adhesive. The coil wound portions and the end cores are bonded to each other while clamping and compressing the coil using the frame-like bobbins.

CITATION LIST

Patent Literature

PTL 1: Japanese Unexamined Patent Application Publication No. 2008-028290

SUMMARY OF INVENTION

Technical Problem

A reactor with increased productivity compared to the related-art reactor is desired.

In a fabrication process of the related-art reactor, since the plurality of core pieces are bonded to each other or bonded to the gap members, many bonding steps are performed. When the numbers of core pieces and the gap members are further increased, the bonding steps further increase accordingly. As described above, many bonding steps cause productivity of the reactor to decrease.

Before the coil is assembled into the reactor, since the coil as it is cannot be maintained in a shape and may extend or contract, handling of the coil is not easy. Thus productivity of the reactor decreases. In particular, when the coil wound portions and the end cores are bonded to each other while compressing the coil as described above in order to decrease the length of the coil in the axial direction, the coil is not easily handled and bonding is not easily performed. Thus, productivity of the reactor further decreases.

In view of the above-described situation, an object of the present invention is to provide a reactor that is fabricated with high productivity.

Solution to Problem

In order to achieve the above-described object, according to the present invention, a molded product in which the shape of a coil is maintained is used, and this coil molded product and a magnetic core are covered with resin.

A reactor according to the present invention includes a magnetic core that is formed of a plurality of core pieces that are combined so as to form an annular shape, a coil molded product that is disposed around an outer periphery of the magnetic core, and an external resin portion that covers an outer periphery of an assembly of the magnetic core and the coil molded product. The coil molded product includes a coil formed of a helically wound wire and an internal resin portion that covers an outer periphery of the coil so as to maintain the shape of the coil. In the reactor, the magnetic core is fixed in the annular shape without use of adhesive.

In this structure, the coil molded product in which the shape of the coil is maintained is provided. Thus, when the coil molded product and the magnetic core is combined into the assembly, handling of the coil is significantly facilitated because the coil does not extend or contract. When the coil is maintained in a state in which the free length of the coil is compressed using the internal resin portion, the coil needs not be compressed when the assembly is formed. By using the coil molded product, the core pieces and other components of the magnetic core can be easily arranged in the coil molded product. Also in this structure, the external resin portion covers the assembly of the magnetic core and the coil molded product. Thus, the external resin portion can function as adhesive, thereby allowing the magnetic core to be maintained in the annular shape. Accordingly, in this structure, the bonding step using adhesive can be omitted and handling of the coil is facilitated. For example, there is no need of compressing the coil while forming the assembly. Thus, the reactor is fabricated with high productivity. In this structure, the insulation property between the magnetic core and the coil can be improved using the internal resin portion. In addition, by maintaining the compressed state of the coil using the internal resin portion, components such as sleeve-like bobbins and an inner case can be omitted. Thus, the number of components can be decreased and the steps of assembling these components can be decreased. Also for this reason, the reactor is fabricated with high productivity.

An embodiment of the reactor according to the present invention may or may not include a case that houses the assembly. When the reactor includes the case, the case is filled with the external resin portion.

When the reactor includes the case, an elastic fixing material may be provided. The elastic fixing member is disposed in the case and presses the magnetic core so as to maintain the magnetic core in the annular shape.

In this structure, the magnetic core that is housed in the case is pressed by the elastic fixing member so as to be in contact with an inner surface of the case. Thus, a clearance is not easily formed between components of the magnetic core such as core pieces. The external resin portion is formed in this pressed state. By doing this, the elastic fixing member and the magnetic core can be fixed in the case using the external resin portion. Thus, decreasing of the pressing force can be suppressed, thereby allowing the magnetic core to be more reliably maintained in the annular shape.

In contrast, when the case is omitted, the reactor may include a belt-like tightening member that maintains the magnetic core in the annular shape.

In this structure, the belt-like tightening member (binding band) is disposed along the outer periphery of the magnetic core that is disposed in an annular shape so as to surround the magnetic core. Thus, by tightening the belt-like tightening member so as to decrease the diameter of a loop formed by the belt-like tightening member, the magnetic core can easily be fixed in the annular shape. By forming the external resin portion in this state, decreasing of tightening force of the belt-like tightening member can be suppressed, and accordingly, the magnetic core can be more reliably maintained in the annular shape. Preferably, a material of the belt-like tightening member has a strength that is sufficient to maintain the magnetic core in the annular shape, is a non-magnetic material because the belt-like tightening member is disposed near the coil, and has a good heat resistance that is sufficient to withstand temperatures such as the temperature that the reactor in operation can reach. The material of the belt-like tightening member includes, for example, a metal material such as stainless steel, and a non-metal material such as resin.

An embodiment of the present invention may include a structure, in which the magnetic core includes the core pieces and at least one gap member. In this case, the core pieces are formed of a magnetic material and the at least one gap member is formed of a non-magnetic material, and, when the at least one gap member includes a plurality of gap members, at least one of the plurality of gap members is formed of an elastic material.

In this structure, even when the core pieces have dimensional errors of a certain magnitude, or the gap members are formed of a material that does not easily deform and has high stiffness such as alumina, by compressing and deforming the gap member formed of an elastic material (referred to as an elastic gap member hereinafter) and curing the external resin portion in this compressed state, the dimensional errors of the core pieces and the like can be absorbed and a reactor having a specified inductance can be realized. In particular, the elastic gap member is easily compressed by pressing using the above-described elastic fixing member or by tightening using the belt-like tightening member. The degree of compression of the elastic gap member (degree of elastic deformation), that is, the gap length between the core pieces, can be easily changed by changing the degree of pressing using the elastic fixing member or the degree of tightening using the belt-like tightening member. This facilitates adjustment of the inductance. Furthermore, when the reactor includes the elastic gap member, precise adjustment of the inductance is performed more easily compared to a case in which the inductance is adjusted by changing the thickness of adhesive applied between the core pieces.

Advantageous Effects of Invention

A reactor according to the present invention uses a coil molded product and is fabricated without adhesive applied in a bonding step. Thus, the reactor is fabricated with high productivity.

DESCRIPTION OF EMBODIMENTS

First Embodiment

Figure 1:
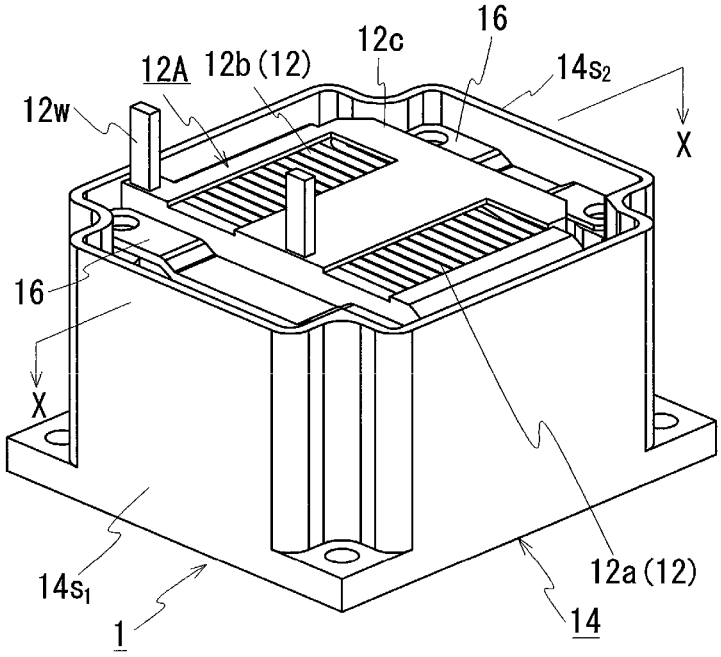
FIG. 1 (I) is a general perspective view of a reactor according to a first embodiment, FIG. 1 (II) is a general sectional view in which a case that is provided in the reactor is cut along line X-X, and FIG. 1 (III) is a front view illustrating an alternative elastic fixing member.
Figure 1:
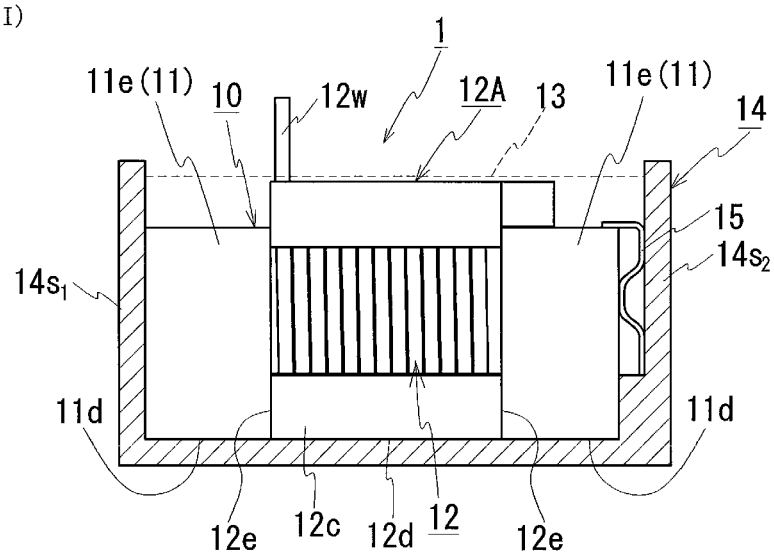
Figure 1:
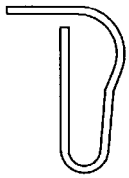

A reactor 1 according to a first embodiment will be described in detail below with reference to FIGS. 1 to 3. In the figures, the same reference numerals are used for similar parts. In FIG. 1 (I), an external resin portion is omitted from the drawing, and in FIG. 1 (ii), a stay is omitted from the drawing. The reactor 1 includes an annular magnetic core 11, a coil molded product 12A, an external resin portion 13 (FIG. 1 (II)), and a case 14. The coil molded product 12A is disposed around an outer periphery of the magnetic core 11, the external resin portion 13 covers an outer periphery of an assembly 10 of the magnetic core 11 and the coil molded product 12A, and the case 14 houses the assembly 10. In application, the reactor 1 is secured to a fixing object such as a cooling base. Most outstanding features of the reactor 1 include the facts that adhesive is not used in the magnetic core 11 and the reactor 1 includes the coil molded product 12A. Components of the reactor 1 will be described in detail below.

<Assembly>

[Magnetic Core]

The magnetic core 11 will be described with reference to FIG. 3 where appropriate. The magnetic core 11 includes a pair of box-like coil wound portions 11*c* and a pair of end cores 11*e*. The coil wound portions 11*c* are surrounded by the coil molded product 12A disposed therearound. The end cores 11*e* are not surrounded by the coil molded product 12A and exposed. The end cores 11*e* are disposed such that the end cores 11*e* clamp the spaced-apart coil wound portions 11*c* so as to form a closed-loop (annular) shape. When a coil 12 is excited, the magnetic core 11 forms a closed magnetic circuit.

Each coil wound portion 11*c* includes core pieces 11*m* and gap members 11*g*. The core pieces 11*m* and the gap members 11*g* are alternately stacked. The core pieces 11*m* are formed of a soft magnetic material containing a ferrous metal such as iron or steel, and the gap members 11*g* are formed of a non-magnetic material such as alumina. The end cores 11*e* are core pieces formed of the soft magnetic material. Each core piece may use a compact of a soft magnetic powder, or a layered structure that includes a plurality of magnetic steel sheets stacked one on top of the other. The gap members 11*g* are plate-like materials disposed at clearances between core pieces 11*m* in order to adjust the inductance. The numbers of the core pieces and the gap members can be suitably selected, so that the reactor 1 has a desired inductance. The shapes of the core pieces and the gap members can also be suitably selected.

Outer peripheral surfaces of the coil wound portions 11*c* are not flush with outer peripheral surfaces of the end cores 11*e* herein. Specifically, a surface on the mounting side of each end core 11*e* when the reactor 1 is mounted on the fixing object such as the cooling base (referred to as a core mounting surface 11*d* (FIG. 1 (II) hereinafter. A surface on the lower side in FIGS. 1 to 3) protrudes from a surface on the mounting side of each coil wound portion 11*c*. The height of each of the end cores 11*e* (a length in a direction perpendicular to a surface of the fixing object (a direction that intersects the axial direction of the coil 12 herein) when the reactor 1 is mounted on the fixing object) is adjusted such that the core mounting surface 11*d* of the end core 11*e* is flush with a surface on the mounting side of the coil molded product 12A (referred to as a molded product mounting surface 12*d* (FIG. 1 (II)) hereinafter. A surface on the lower side in FIGS. 1 to 3).

[Coil Molded Product]

Figure 2:
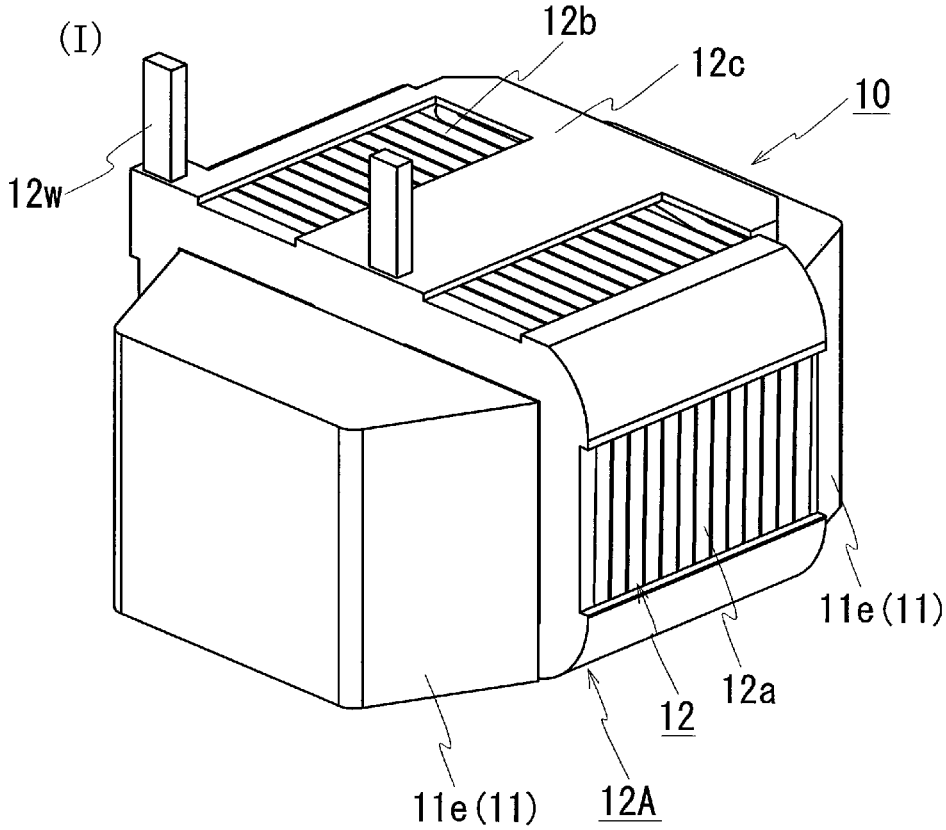
FIG. 2 (I) is a general perspective view of an assembly of a magnetic core and a coil molded product that is provided in the reactor according to the first embodiment, and FIG. 2 (II) is a general perspective view of a coil that is provided in the coil molded product.
Figure 2:
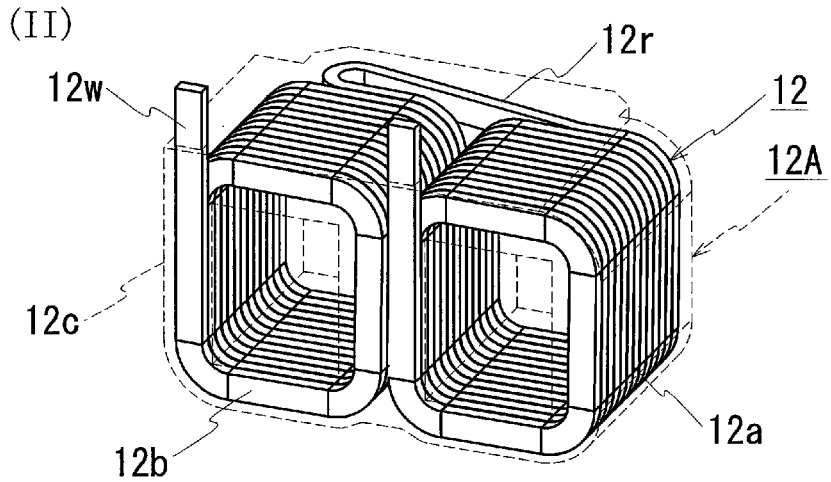
Figure 3:
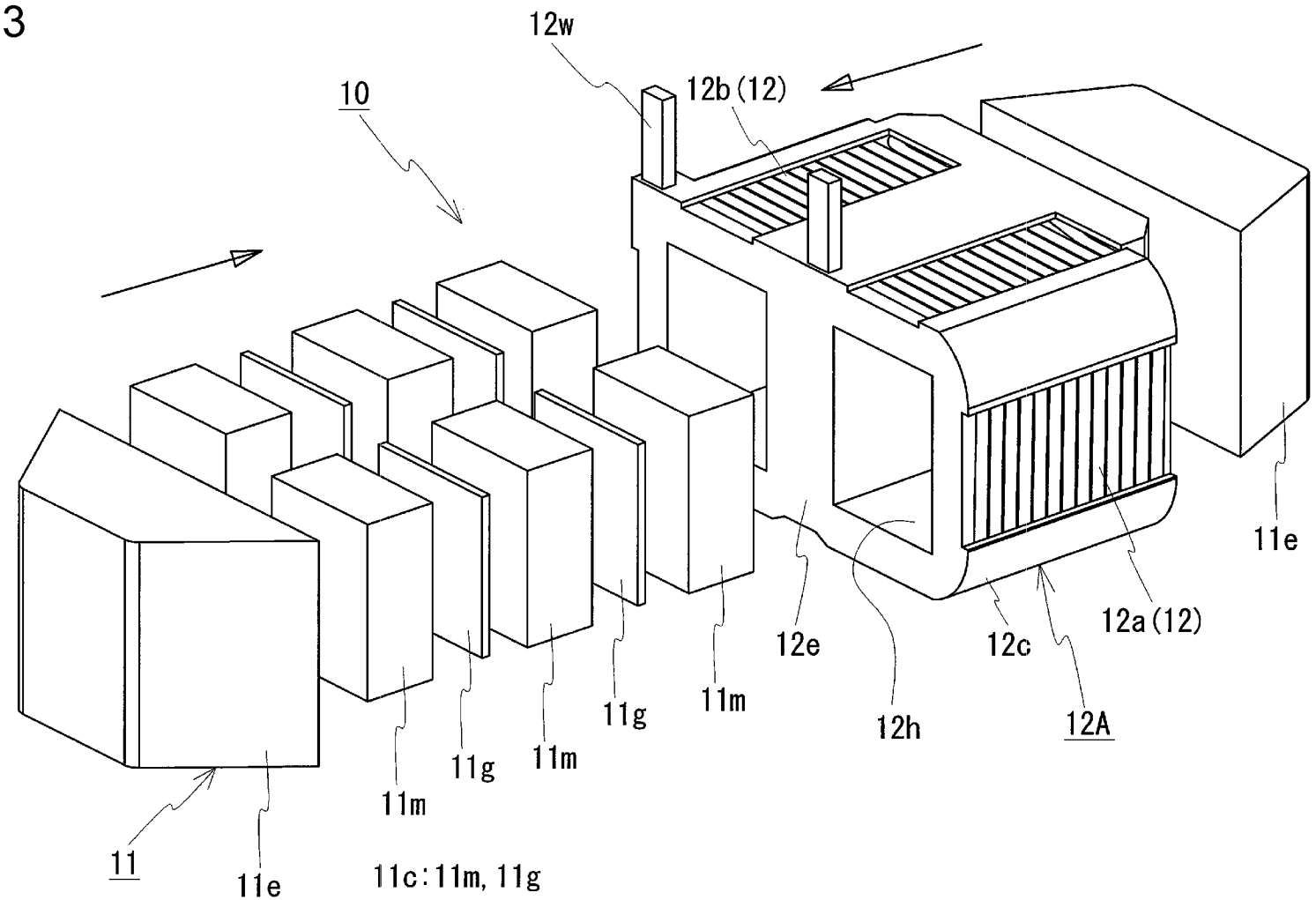
FIG. 3 is an exploded perspective view illustrating a procedure of assembling the assembly of the magnetic core and the coil molded product that is provided in the reactor according to the first embodiment.

As illustrated in FIG. 2 (II), the coil molded product 12A includes the coil 12 and an internal resin portion 12*c*. The coil 12 includes a pair of coil elements 12*a* and 12*b* formed of a helically wound single continuous wire 12*w*. The internal resin portion 12*c* covers the outer periphery of the coil 12.

(Coil)

The coil elements 12*a* and 12*b* are formed so as to have a side-by-side structure in which the axis directions of the coil elements 12*a* and 12*b* extend parallel to each other. A covered wire, in which an outer periphery of a conductor is surrounded by an insulating coating layer, is preferably used as the wire 12*w*. The wire used herein is a covered rectangular wire that has a copper rectangular wire as the conductor and enamel (typically polyamideimide) as the insulating coating layer. The coil elements 12*a* and 12*b* are edgewise coils formed by winding the covered rectangular wire edgewise, and end surfaces of the coil elements 12*a* and 12*b* have a race track-like shape. A rewinding portion 12*r*, which is part of the wire 12*w*, connects the coil elements 12*a* and 12*b* to each other. Instead of the rectangular wire, the conductor of the wire may be a wire having one of variety of sectional shapes such as a circular shape and a polygonal shape. Alternatively, the coil elements may be formed of separately wound wires, which are integrated into a coil by connecting the ends of the wound wires using welding or another connecting method. In this case, the rewinding portion is not required. Thus, for example, ease of compressing the coil element increases when molding the internal resin portion. This allows the molded product to be fabricated with good manufacturability.

Each end of the wire 12*w* that forms the coil 12 suitably extends from turn-formed portions through the outside of the internal resin portion 12*c* to the outside of the external resin portion 13 (FIG. 1 (I) and FIG. 1 (II)). The insulating coating layer is removed from each end of the wire 12*w*. The exposed conducting portions are connected to a terminal member (not shown) formed of an electrically conducting material. A power source unit that supplies power or other external device (not shown) is connected to the coil 12 through the terminal member. The conducting portions of the wire 12*w* may be connected to the terminal member using, for example, welding such as tungsten inert gas (TIG) welding.

(Internal Resin Portion)

Outer peripheries of the coil elements 12*a* and 12*b* are covered with the internal resin portion 12*c*, which maintains each of the coil elements 12*a* and 12*b* in a specified shape. The coil elements 12*a* and 12*b* herein are each maintained in a compressed state using the internal resin portion 12*c*. The internal resin portion 12*c* herein covers the coil 12 substantially along the outline of the coil 12. However, the ends of the wire 12*w* and part of outer peripheral surfaces of the turn-formed portions of the coil elements 12*a* and 12*b* are not covered by a resin component of the internal resin portion 12*c* and are exposed. That is, the internal resin portion 12*c* has an outer peripheral surface having a concave shape. The coil molded product 12A may be formed similarly to a coil molded product 22A in a second embodiment, which will be described later, in which the wire 12*w* is entirely covered with an internal resin portion 22*c* except for each end of the wire 12*w*. Part of the internal resin portion 12*c* that covers the turn-formed portions of the coil elements 12*a* and 12*b* is formed to have a substantially uniform thickness, and the part of the internal resin portion 12*c* that covers the rewinding portion 12*r* protrudes in the axial direction of the coil. When the reactor 1 is assembled, surfaces of the internal resin portion 12*c* and the exposed turn-formed portions contact inner surfaces of the external resin portion 13.

The inner peripheries of the coil elements 12*a* and 12*b* are also covered with the resin component of the internal resin portion 12*c* and have hollow bores 12*h* (FIG. 3) formed in the resin component. The coil wound portions 11*c* (FIG. 3) of the magnetic core 11 are inserted into the hollow bores 12*h*. The thickness of the resin component of the internal resin portion 12*c* is adjusted such that the coil wound portions 11*c* are disposed at appropriate positions in the inner peripheries of the respective coil elements 12*a* and 12*b*. The shape of each hollow bore 12*h* is also adjusted to the outer shape (a box shape herein) of the coil wound portion 11*c*. Thus, the resin component of the internal resin portion 12*c* that is disposed over the inner periphery of the coil elements 12*a* and 12*b* functions as a positioning portion of the coil wound portions 11*c*.

The resin component of the internal resin portion 12*c* is herein disposed so as to entirely cover the inner peripheries of the coil elements 12*a* and 12*b*. However, as long as the resin component is disposed so as to allow an insulation property between the magnetic core 11 and the coil 12 to be improved and the coil wound portions 11*c* to be positioned, part of the inner peripheral surfaces of the coil elements 12*a* and 12*b* may be exposed from the above-described resin component. That is, part of the hollow bores into which the core pieces 11*m* and the gap members 11*g*, which are part of the coil wound portions 11*c*, are inserted may be recessed. When part of the hollow bores is recessed, a resin material of the external resin portion 13 easily flows into recessed portions, thereby allowing sufficient delivery of the resin material to outer peripheries of the core pieces 11*m* and the gap members 11*g* disposed in the hollow bores. This increases an area in which a resin component of the external resin portion 13 and the core pieces 11*m* and the like are in contact with each other. For this reason, this should facilitate maintaining of the magnetic core 11 in the annular shape.

A resin material of the internal resin portion 12*c* may preferably be a material that has a heat resistance sufficiently preventing the material, when the reactor 1 including the coil molded product 12A is used, from being softened due to heat at the maximum temperature that the coil 12 or the magnetic core 11 can reach, and can be processed using transfer molding or injection molding. In particular, the material having a good insulation property is preferable. Specifically, thermosetting resin such as epoxy resin, or thermoplastic resin such as polyphenylene sulfide (PPS) resin or liquid crystal polymer (LCP) may preferably be used. Herein, epoxy resin is used. The internal resin portion 12*c* preferably has a good heat dissipation property since the internal resin portion 12*c* contacts the coil 12, the temperature of which tends to rise. The heat dissipation property can be increased when the resin material of the internal resin portion 12*c* is, for example, resin that includes a filler formed of at least one ceramic selected from the group consisting of silicon nitride, alumina, aluminum nitride, boron nitride, and silicon carbide.

(Fabrication of Coil Molded Product)

The above-described coil molded product 12A can be fabricated using a mold as described below. That is, a mold including a pair of first and second mold segments that can open and close relative to each other can be used. The first mold segment includes an end plate that is disposed on one end side of the coil 12 (for example, a side from which the ends of the wire 12*w* extend in FIG. 2 (II)) and box-like cores which are inserted into the inner peripheries of the coil elements 12*a* and 12*b*. The second mold segment includes an end plate disposed on the other end of the coil (for example, the rewinding portion 12*r* side in FIG. 2 (II)) and peripheral sidewalls that cover the periphery of the coil 12. The first and second mold segments include a plurality of rod-like elements that are movable back and forth inside the mold using a drive mechanism. The rod-like elements are used to suitably press the end surfaces of the coil elements 12*a* and 12*b* (surfaces where the turn-formed portions appears annular) in order to compress the coil elements 12*a* and 12*b*. The rod-like elements preferably have a strength that is sufficient to compress the coil 12 and a heat resistance against heat exposed at such time as when the internal resin portion 12*c* is molded. In addition, the rod-like elements preferably have a thinner structure as much as possible so as to decrease portions of the coil 12 that are not covered by the internal resin portion 12*c*.

The wire 12*w* is helically wound into the coil 12, which is set into the mold so as to form a certain clearance between surfaces of the mold and the coil 12. At this time, the coil 12 has not yet been compressed.

Then, the mold is closed and the cores of the first mold segment are inserted into the inner peripheries of the coil elements 12*a* and 12*b*. At this time, a clearance between each of the cores and the inner periphery of corresponding one of the coil elements 12*a* and 12*b* is substantially uniformly formed over the entire periphery of the core.

Next, the rod-like elements are moved into the mold in order to compress the coil elements 12*a* and 12*b*. By compressing the coil elements 12*a* and 12*b*, clearances between adjacent turns of the coil elements 12*a* and 12*b* are narrowed, and the coil 12 is maintained in a state in which the free length of the coil 12 is compressed.

The mold is filled with resin injected thereinto through a resin injection channel while the above-described compressed state is maintained. After the resin has been cured, the mold is opened and the coil molded product 12A maintained in the compressed state using the resin is moved out of the mold. A plurality of small holes having been formed at positions pressed by the rod-like elements, may be filled with a suitable insulating material, or may be left as they are in this step. In the latter case, the holes are filled with the external resin portion 13. In order to form hollow bores part of which is recessed, cores having protrusions or recesses may be used.

<External Resin Portion>

The magnetic core 11 and the coil molded product 12A are combined into the assembly 10. As illustrated in FIG. 1, the assembly 10 is housed in the case 14 and the outer periphery thereof is covered with the external resin portion 13 with which case 14 is filled. One of the functions of the external resin portion 13 is that the external resin portion 13 maintains the magnetic core 11 in an annular shape.

The resin material of the external resin portion 13 may be, for example, epoxy resin, urethane resin, PPS resin, polybutylene terephthalate (PBT) resin, acrylonitrile butadiene styrene (ABS) resin, unsaturated polyester (BMC), or the like. The resin material of the external resin portion 13 may be or may not be the same as that of the internal resin portion 12*c* of the coil molded product 12A. The above-described filler formed of the ceramic may be included in the resin material of the external resin portion 13 in order to increase the heat dissipation property. Since the reactor 1 includes the internal resin portion 12*c* having a good heat dissipation property, a heat dissipation property of the entire reactor 1 is good even when a heat dissipation property of the resin material of the external resin portion 13 is slightly decreased. The resin material of the external resin portion 13 used herein is unsaturated polyester (BMC) or epoxy resin.

<Case>

The case 14 that houses the above-described assembly 10 is a rectangular box-like structure formed of aluminum. The case 14 has the bottom surface and four sidewalls extending upward from the bottom surface. The case 14 may be a known case. The assembly 10 is housed in the case 14 such that the end cores 11*e* are disposed between inner surfaces of a pair of opposing sidewalls 14$s_1$ and 14$s_2$ out of the four sidewalls of the case 14.

<Flat Spring>

A flat spring 15 (elastic fixing member) is disposed in the case 14 so as to contact the end surface of one of the end cores 11*e* of the assembly 10 and the inner surface of the one sidewall 14$s_2$ of the case 14. The flat spring 15 presses the assembly 10 (magnetic core 11 in particular) toward the other sidewall 14$s_1$ of the case 14, thereby allowing the magnetic core 11 to be more reliably maintained in a state in which the magnetic core 11 is arranged in an annular shape. The shape, number and location of the flat spring may be suitably selected. The flat spring 15 herein is formed of a stainless steel plate that is bent such that part of the flat spring 15 is protruded. More specifically, as illustrated in FIG. 1 (II), the flat spring 15 is disposed such that one end of the flat spring 15 contacts the case 14, a protrusion formed at an intermediate portion of the flat spring 15 contacts the end surface of the end core 11*e* so as to press the magnetic core 11 toward the sidewall 14$s_1$ side of the case 14, and the other end of the flat spring 15 contacts an upper surface of the end core 11*e* so as to press the magnetic core 11 toward the bottom surface side of the case 14. Alternatively, the plate spring may be, for example, a metal plate, one end side of which is curved so as to form a loop-like shape as illustrated in FIG. 1 (III).

<Procedure of Assembly of Reactor>

The reactor 1 having the above-described structure can be assembled as follows.

The coil molded product 12A is initially prepared as described above. Then, as illustrated in FIG. 3, the coil molded product 12A is disposed such that one of end surfaces 12*e* of the coil molded product 12A contacts one of the end cores 11*e* so as to close one of the openings of each of the hollow bores 12*h*. In this state, the core pieces 11*m* and the gap members 11*g* are alternately inserted into the hollow bores 12*h*. As described above, in the hollow bores 12*h*, the resin component of the internal resin portion 12*c* of the coil molded product 12A is formed to have a specified thickness. Thus, the core pieces 11*m* and the gap members 11*g* having been inserted into the hollow bores 12*h* are disposed at appropriate positions relative to the coil elements 12*a* and 12*b*. The hollow bores 12*h* can also sufficiently support the core pieces 11*m* and the like using the resin component of the internal resin portion 12*c*. Next, the other one of the end surfaces 12*e* of the coil molded product 12A is contacted by the other end core 11*e* such that the coil wound portions 11*c* and the coil molded product 12A are clamped by both the end cores 11*e*. With these steps, the assembly 10 is obtained.

The assembly 10 is housed in the case 14 while the assembled state of the assembly 10 is maintained (FIG. 1 (I)). As described above, the core mounting surface 11*d* of each of the end cores 11*e* is flush with the molded product mounting surface 12*d* of the coil molded product 12A. Thus, the assembly 10 is stably supported by the bottom surface of the case 14. Next, the flat spring 15 is inserted between the end surface of one of the end cores 11*e* of the assembly 10 and the inner surface of the sidewall 14$s_2$ of the case 14 that opposes this end surface of the end core 11*e* such that the flat spring 15 presses this end surface of the end core 11*e* toward the other sidewall 14$s_1$ side of the case 14. The magnetic core 11 can be more reliably maintained in the annular shape due to a pressure caused by the flat spring 15. Furthermore, in the reactor 1, a stay 16 is disposed on the upper surface of each of the end cores 11*e* and fastened to the case 14 using bolts (not shown). Thus, the assembly 10 is more reliably secured to the case 14. The stays 16 and the bolts may be omitted.

The case 14 is filled with resin so as to cover the flat spring 15 and the outer periphery of the assembly 10 housed in the case 14. Thus, the external resin portion 13 is formed. The ends of the wire 12*w* are exposed from the external resin portion 13. With the above-described steps, the reactor 1 is obtained. In the obtained reactor 1, the magnetic core 11 is maintained in the annular shape using the cured external resin portion 13 and the flat spring 15.

<Advantages>

In the above-described reactor 1, adhesive is not used in fixing the magnetic core 11, which includes a plurality of core pieces 11*m* and gap members 11*g*, in the annular shape. The annular shape is fixed by covering the outer periphery of the assembly 10 using the external resin portion 13. With this structure, bonding steps are eliminated, and the reactor 1 is fabricated with high productivity. Since the reactor 1 includes the coil molded product 12A, the coil 12 is easily handled. Thus, for example, the coil 12 needs not be compressed while fixing the magnetic core 11 in the annular shape. This also increases the productivity. Since the coil molded product 12A is used, the core pieces 11*m* and the gap members 11*g* are housed in the hollow bores 12*h* of the coil molded product 12A as described-above, and the end cores 11*e* are disposed so as to close the openings of the hollow bores 12*h*. Thus, even when the core pieces 11*m* and the like are not secured using adhesive and apart from each other during assembly of the reactor 1, the core pieces 11*m* and the like housed in the hollow bores 12*h* do not easily fall off. In the coil molded product 12A, by covering also the inner peripheries of the coil elements 12*a* and 12*b* using the resin component of the internal resin portion 12*c*, and by forming the resin component of the internal resin portion 12*c* so as to have a specified thickness and shape, the internal resin portion 12*c* can be used in positioning the coil wound portions 11*c* of the magnetic core 11. Also for this reason, the reactor 1 is fabricated with high productivity since the magnetic core 11 can be easily positioned while positioning members such as sleeve-like bobbins are not required.

In addition, since the reactor 1 has a structure in which the assembly 10 is pressed using the flat spring 15 and the like, the positions of the core pieces 11*m* and the like are not easily shifted. This allows the magnetic core 11 to be maintained in a specified shape, and accordingly, inductance mismatching due to a change in the distance between the core pieces 11*m* resulting from loosening of a fixed state does not easily occur. Also in the reactor 1, the core mounting surface 11*d* of each of the end cores 11*e* is flush with the molded product mounting surface 12*d* of the coil molded product 12A and in contact with the bottom surface of the case 14. This facilitates arrangement of the assembly 10 in the case 14. Also for this reason, the reactor 1 is fabricated with high productivity. Due to contact of the core mounting surfaces 11*d* and the molded product mounting surface 12*d* with the bottom surface of the case 14, heat can be efficiently transferred from the magnetic core 11 and the coil 12 to the case 14. Thus, the reactor 1 has a good heat dissipation property. Due to the internal resin portion 12*c* that is disposed between the coil 12 and the bottom surface of the case 14, an insulation property between the coil 12 and the case 14 can be improved. Since the end cores 11*e* protrude more than the respective coil wound portions 11*c*, when the volume of the magnetic core is the same as the volume of a magnetic core including the end cores and the coil wound portions that are made to be flush with each other, the length of the coil in the axial direction can be decreased in the reactor. Thus, the size of the reactor 1 is reduced. In the reactor 1, part of the outer periphery surface of the coil molded product 12A is recessed. Thus, an area by which the coil molded product 12A and the external resin portion 13 are in contact with each other increases, thereby allowing the coil molded product 12A and the external resin portion 13 to be more tightly in contact with each other. Since the reactor 1 includes the internal resin portion 12*c*, the external resin portion 13, and the case 14, the coil 12 and the magnetic core 11 can be protected from the environment and can be mechanically protected.

Second Embodiment

Figure 4:
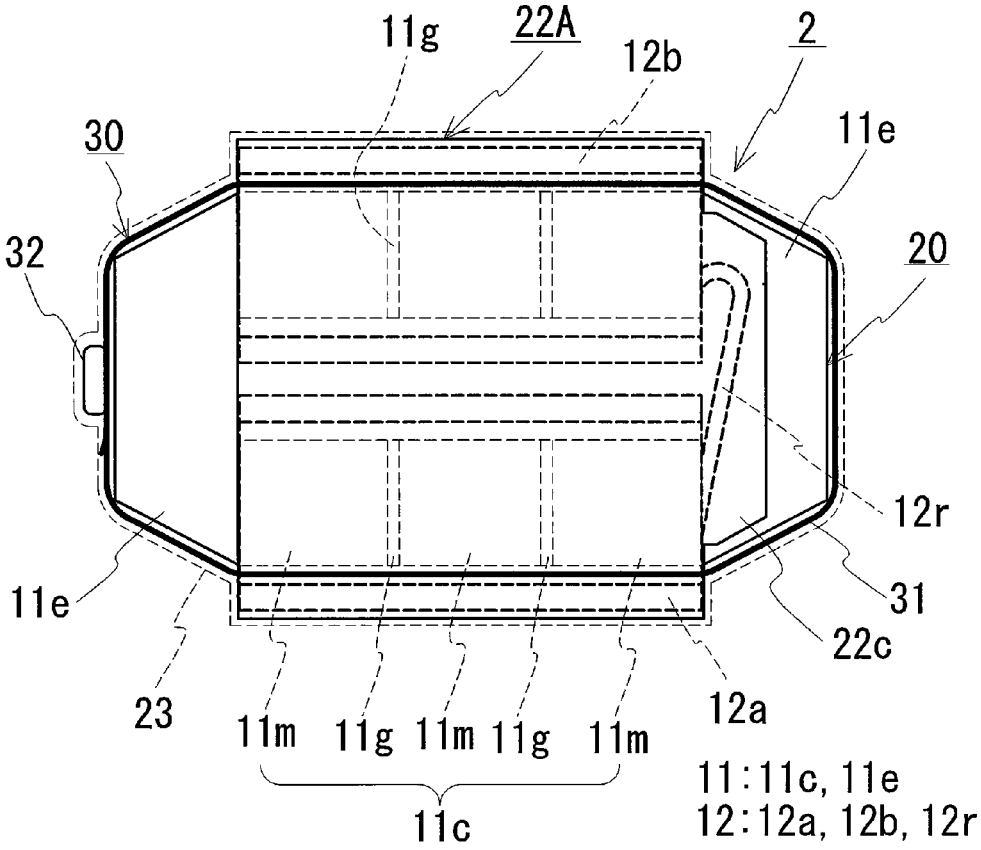
FIG. 4 is a top view schematically illustrating a reactor according to a second embodiment.

A reactor 2 according to a second embodiment will be described in detail below with reference to FIGS. 4 and 5. In the first embodiment, the case is provided. In the second embodiment, the case is omitted. The reactor 2 includes the annular magnetic core 11, a coil molded product 22A, and an external resin portion 23. The external resin portion 23 covers an outer periphery of an assembly 20 of the magnetic core 11 and the coil molded product 22A. The reactor 2 does not include a case. In application, the external resin portion 23 or other component of the reactor 2 is secured to a fixing object such as the cooling base. The differences between the reactor 1 and the reactor 2 is that the reactor 2, as described above, does not include the case, and the reactor 2 includes a belt-like tightening member 30, which is disposed around the outer periphery of the magnetic core 11. The description below is dedicated to these differences, and the description on the other structures, which are generally the same as the reactor 1 in the first embodiment, is omitted.

[General Structure]

As described above, the reactor 2 includes the belt-like tightening member 30 that is disposed around the outer periphery of the magnetic core 11. The external resin portion 23 and the belt-like tightening member 30 maintain the magnetic core 11 in the annular shape. The belt-like tightening member 30 is also inserted through hollow bores 22*h* of the coil molded product 22A (FIG. 5). Thus, the assembly 20 of the magnetic core 11 and the coil molded product 22A are integrated using the belt-like tightening member 30.

[Belt-Like Tightening Member]

The belt-like tightening member 30 includes a belt portion 31 and a lock portion 32. The belt portion 31 is disposed around the outer periphery of the magnetic core 11. The lock portion 32 is attached to one end of the belt portion 31 and fixes a loop formed by the belt portion 31 in a specified length. In a certain area extending from the other end of the belt portion 31 in a longitudinal direction of the belt portion 31, a plurality of thin protrusions (not shown) that are formed in a width direction of the belt portion 31 are arranged side by side in the longitudinal direction of the belt portion 31. The lock portion 32 has an insertion hole (not shown) and a tooth portion (not shown). The other end side of the belt portion 31, on which the above-described protrusions are formed, is inserted through the insertion hole. The tooth portion is formed at the insertion hole so as to be engageable with the protrusions. The protrusions of the belt portion 31 and the tooth portion of the lock portion 32 form a mechanism, for example, that allows the protrusions to move beyond the tooth portion in the advancing direction (tightening direction) of the belt portion 31, and blocks the protrusions from moving backward because of engagement of one of the protrusions with the tooth portion (ratchet mechanism). The length and width of the belt portion 31 may be suitably determined with consideration of the size and the like of the magnetic core 11. The belt-like tightening member 30 used herein is formed of a non-metal material. The belt portion formed of a non-metal material produces small magnetic effects (no eddy current losses are caused) even when the belt portion is inserted through the inner periphery of the coil 12 as is the case with the reactor 2, and accordingly, can decrease losses that would be produced by the magnetic effects. Specifically, the non-metal material may include heat-resistant polyamide resin, polyetherether ketone (PEEK) resin, polyethylene terephthalate (PET) resin, polytetrafluoroethylene (PTFE) resin, and PPS resin. For example, a commercial biding product formed of heat resistant insulating resin (for example, a ty-rap (registered trademark of Thomas and Betts International Inc.) or a peek tie (a binding band manufactured by HellermannTyton Co., Ltd.)) may be used. Although the reactor 2 described herein includes one belt-like tightening member 30, the reactor 2 may include a plurality of belt-like tightening members that are disposed side by side. By using a plurality of belt-like tightening members, the magnetic core can be more reliably fixed in the annular shape.

The loop formed by the belt-like tightening member 30 is fixed in a desired size by performing the following procedure. That is, the belt portion 31 is initially inserted through the insertion hole of the lock portion 32 from the other end of the belt portion 31 so as to form a loop. Then, the other end of the belt portion 31 is pulled in order to decrease the diameter of the loop, and one of the protrusions of the belt portion 31 is suitably engaged with the tooth portion of the lock portion 32. By suitably selecting the position of the protrusion to be engaged with the tooth portion, the loop can be fixed in a desired size.

Each of the hollow bores 22*h* of the coil molded product 22A has a belt groove 22*g* (FIG. 5), which is formed in the internal resin portion 22*c* using resin molding. The belt-like tightening member 30 is positioned when the belt-like tightening member 30 is disposed in the belt grooves 22*g* of the hollow bores 22*h* of the coil molded product 22A.

[External Resin Portion]

An outer periphery of the assembly 20 that includes the belt-like tightening member 30 is covered with the external resin portion 23. The external resin portion 23 herein is formed substantially along the outline of the assembly 20 using cast molding of epoxy resin after the assembly 20 has been fabricated. The external resin portion 23 may be formed using transfer molding or injection molding instead of cast molding. In order to use transfer molding or injection molding, a material of the belt-like tightening member, a molding pressure, and the like may be suitably selected and adjusted in order to prevent the belt-like tightening member 30 and the like from being damaged. The ends of the wire 12*w* (see FIG. 5. Not shown in FIG. 4) are exposed from the external resin portion 23. The core mounting surfaces of the end cores 11*e* of the magnetic core 11 and the molded product mounting surface of the coil molded product 22A are also exposed from the external resin portion 23. The core mounting surfaces and the molded product mounting surface are flush with a surface on a mounting side (referred to as a resin mounting surface hereinafter) of the external resin portion 23. Thus, when the reactor 2 is mounted on the fixing object, all of the above-described core mounting surfaces, the molded product mounting surface, and the resin mounting surface contact the fixing object. The reactor 2 may be mounted on the fixing object by, for example, fastening staple-like securing members (not shown), which are disposed on the end cores 11*e* so as to cover the end cores 11*e*, with bolts or the like. Alternatively, bolt holes may be formed in a resin component of the external resin portion in order to mount the reactor 2 on the fixing object.

Although an average thickness of the external resin portion 13 is uniformly set to 1 to 2 mm herein, the thickness and an area with which the assembly 20 is covered may be suitably selected. For example, not only the core mounting surfaces of the end cores 11*e* and the molded product mounting surface of the coil molded product 22A but also part of the end cores 11*e* and part of the coil molded product 22A may not be covered with the resin component of the external resin portion and be exposed.

<Procedure of Assembly of Reactor>

The reactor 2 having the above-described structure can be assembled in the following procedure.

Figure 5:
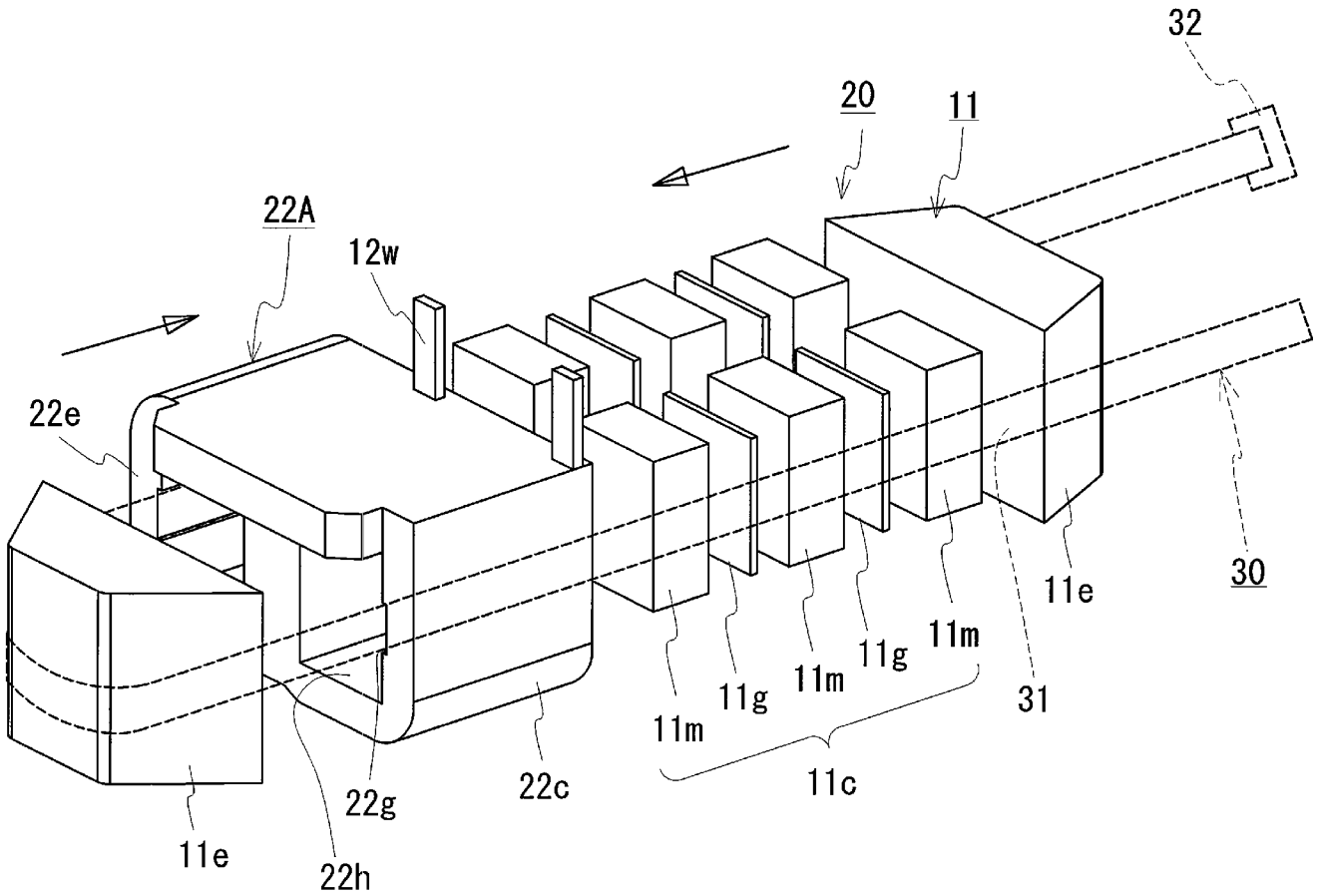
FIG. 5 is an exploded perspective view illustrating a procedure of assembling an assembly of the magnetic core and a coil molded product that is provided in the reactor according to the second embodiment.

As illustrated in FIG. 5, the belt portion 31 of the belt-like tightening member 30 is initially inserted through the hollow bores 22*h* so as to be routed from one of the hollow bores 22*h* to the other hollow bore 22*h* of the coil molded product 22A. At this time, the belt portion 31 is disposed so as to be fitted into the belt groove 22*g* of each of the hollow bores 22*h*.

Then, part of the belt portion 31 extending between the hollow bores 22*h* is pulled in a direction in which the part of the belt portion 31 is moved away from the coil molded product 22A, thereby forming a curved portion. One of the end cores 11*e* is disposed such that the curved portion of the belt portion 31 is routed along the outer periphery of this end core 11*e*. Next, each end of the belt portion 31 is pulled in order to decrease the diameter of the curved portion, and to bring the end surface of the one of the end cores 11*e* into contact with one of end surfaces 22*e* of the coil molded product 22A. At this time, one of openings of each of the hollow bores 22*h* is closed using the one end core 11*e*. In this state, the core pieces 11*m* and the gap members 11*g*, which are included in the coil wound portions 11*c*, are inserted into the hollow bores 22*h* from the other opening of each of the hollow bores 22*h*. After that, the other end core 11*e* is disposed so as to close the openings and to be in contact with the end surface of each of the coil wound portions 11*c* and the other end surface 22*e* of the coil molded product 22A. By doing this, in the magnetic core 11, the two coil wound portions 11*c* are clamped by both the end cores 11*e*, thereby forming an annular structure.

Through the insertion hole of the lock portion 32 that is provided on one of the end sides of the belt portion 31 of the belt-like tightening member 30, the other end side of the belt portion 31 is inserted and pulled in order to decrease the diameter of the loop formed by the belt portion 31, thereby tightening the magnetic core 11 arranged in the annular shape. At this time, part of the belt portion 31 is held by the belt grooves 22*g*. This facilitates arrangement of the belt portion 31 along the outer periphery of the magnetic core 11 and decrease a possibility that the position of the belt portion 31 is shifted. Then, one of the protrusions of the belt portion 31 is suitably hooked to the tooth portion of the lock portion 32 in order to determine the size of the loop and fix the state of the annular shape of the magnetic core 11.

With these steps, the assembly 20 is obtained. Since the obtained assembly 20 is fixed in a state in which the assembly 20 is tightened using the belt-like tightening member 30, the end cores 11*e* and the like do not fall off from the assembly 20. Thus, the magnetic core 11 and the coil molded product 22A can be handled as an integrated unit. The reactor 2 is obtained by forming the external resin portion 23 over the integrated unit. In the reactor 2 illustrated in FIG. 4, a slight clearance is drawn between the belt-like tightening member 30 and the magnetic core 11 to facilitate understanding of the structure. In the actual reactor 2, the belt-like tightening member 30 contacts the outer periphery of the magnetic core 11.

<Advantages>

In the reactor 20 having the above-described structure, as is the case with the reactor 1 in the first embodiment, adhesive is not used at all in fixing the magnetic core 11 in the annular shape. In addition, the coil molded product 22A is provided, thereby facilitating handling of the coil 12 and positioning of the coil wound portions 11*c* without use of the sleeve-like bobbins or the like. Thus, high productivity is achieved. In particular, since the magnetic core 11 of the reactor 2 can be maintained in the annular shape using the belt-like tightening member 30, it is unlikely that the core pieces 11*m* and the like fall off from the coil molded product 22A during assembly of the reactor 2. This facilitates fabrication of the reactor 2. In the reactor 2, the belt grooves 22*g* are formed in a resin component of the coil molded product 22A. This facilitates positioning of the belt-like tightening member 30. Also for this reason, the reactor 2 is fabricated with high productivity. In addition, since the belt-like tightening member 30 can be held using the belt groove 22*g* before and after the belt-like tightening member 30 is tightened, the position of the belt-like tightening member 30 is unlikely to be shifted. This allows the magnetic core 11 to be more reliably maintained in the annular shape. The external resin portion 23 is formed in a state in which the belt-like tightening member 30 has been disposed. Thus, the magnetic core 11 of the reactor 2 can be more reliably maintained in the annular shape.

In the reactor 2, the belt-like tightening member 30 is disposed so as to contact the substantially entire range of the outer periphery of the magnetic core 11. Thus, tightening force of the belt-like tightening member 30 can be sufficiently applied to the magnetic core 11. For this reason, in the reactor 2, the positions of the core pieces are unlikely to be shifted, and the magnetic core 11 can be maintained in a specified shape. Thus, inductance mismatching due loosening of the fixed state and the like does not easily occur. Since the molded product mounting surface of the coil molded product 22A is flush with the core mounting surfaces of the end cores 11*e* also in the reactor 2, these mounting surfaces can contact the fixing object such as a cooling base. This realizes a good heat dissipation property and allows the assembly 20 to be more stably supported by the fixing object. In addition, the belt-like tightening member 30 of the reactor 2 is also formed of insulating resin. This ensures insulation between the belt-like tightening member 30 and the coil 12 even when the belt-like tightening member 30 is disposed near the coil 12. The size of the reactor 2 is small since the reactor 2 does not include the case. However, by providing the reactor 2 with the internal resin portion 22*c* and the external resin portion 23, the magnetic core 11 and the coil 12 can be protected from the environment and can be mechanically protected.

(Modification 2-1)

In the above-described second embodiment, the belt-like tightening member 30 is inserted through the inner peripheries of the coil 12 of the coil molded product 22A. Alternatively, the belt-like tightening member may be disposed around the outer periphery of the coil molded product. With this structure, even when the belt-like tightening member is formed of a metal material such as stainless steel, a reactor with small losses due to magnetic effects can be obtained. The belt-like tightening member that is formed of metal is preferable because of high strength and good heat resistance. Also with this structure, the number of positions of the magnetic core that are directly contacted by the belt-like tightening member is decreased. Thus, damage to the magnetic core due to contact with the belt-like tightening member does not easily occur. The belt-like tightening member formed of a metal material may use, for example, the following structure. That is, by firmly pressing a lock portion that includes a ball using a jig, an end side of the belt portion that is inserted through the insertion hole of the lock portion is pressed by the ball, thereby fixing a loop. A commercial biding product (for example, a stainless steel band (manufactured by Panduit Corporation)) may be used.

(Modification 2-2)

In a structure including the belt-like tightening member 30, a cushioning member may be provided between the outer periphery of the magnetic core 11 and the belt-like tightening member 30 in order to suppress the possibility of damage to the magnetic core due to tightening force of the belt-like tightening member. The material, thickness, number, location, and the like of the cushioning member may be suitably selected so as to apply a tightening force that is sufficient to maintain the annular magnetic core in the specified shape to the magnetic core. The cushioning member may use, for example, a molded component having a thickness of about 0.5 to 2 mm formed of resin such as ABS resin, PPS resin, PBT resin, or epoxy resin molded so as to fit the shape of the core, or a component such as a rubber plate product formed of silicone rubber.

(Modification 2-3)

In the above-described second embodiment, the case is omitted. However, the reactor of the second embodiment may include the case. In this case, the magnetic core 11 and the coil molded product 22A are integrated into a unit using the belt-like tightening member 30. Thus, assembly 20 is easily housed in the case. Since the magnetic core 11 is sufficiently maintained in the annular shape using the belt-like tightening member 30 without flat spring as used in the first embodiment. Thus, the flat spring may be omitted in the present modification.

(Modification I)

In the above-described first and second embodiments, the gap members 11*g* provided in the magnetic core 11 are formed of a material having high stiffness such as a ceramic (alumina). The gap members may include at least one elastic gap member formed of an elastic material. In this case, in order to obtain a reactor that has a specified inductance, for example, the external resin portion is cured while the assembly (the magnetic core) is pressed using an external jig, a flat spring, or the like, or the elastic gap member is compressed by the belt-like tightening member that is tightened so as to fix the loop of the belt-like tightening member in this compressed state. With this structure, deformation of the elastic gap member can absorb dimensional errors that may occur in the core pieces and the like. The compressed state of the elastic gap member can be easily changed by adjusting pressing force of the external jig or the flat spring, length of the loop of the belt-like tightening member, or the like. Thus, the inductance can be easily and correctly adjusted with this structure.

Preferably, the elastic material has a hardness of 40 to 90 degrees when measuring in compliance with JIS K 6253: 2006 (durometer type A), has a heat resistance that is sufficient to withstand the temperature that the reactor in operation reaches (preferably, 150° C. or higher), and has an insulation property. The elastic material may be, for example, silicone rubber, fluorine rubber, and acrylic rubber. The number, shape, and the like of the elastic gap member may be suitably selected. All the gap members may be elastic gap members.

(Modification II)

In the above-described first and second embodiments, the flat spring or the belt-like tightening member is used. However, these components may be omitted. In this case, when the external resin portion is molded, the assembly may be positioned using pins or the like after the assembly is set in the case or the mold such that the assembly of the magnetic core and the coil is arranged in a specified positional relationship.

The present invention is not limited to the above-described embodiments and may be suitably modified without departing from the gist of the present invention.

INDUSTRIAL APPLICABILITY

The reactor according to the present invention is preferably used as a component or the like of a converter that is installed in, for example, a vehicle such as a hybrid vehicle, an electrical vehicle, or a fuel-cell vehicle.

REFERENCE SIGNS LIST

1, 2 reactor 10, 20 assembly 11 magnetic core 11*c* coil wound portion 11*e* end core 11*m* core piece 11*g* gap member 11*d* core mounting surface 12A, 22A coil molded product 12 coil 12*a*, 12*b* coil element 12*r* rewinding portion 12*w* wire 12*c*, 22*c* internal resin portion 12*h*, 22*h* hollow bore 12*e*, 22*e* end surface 12*d* molded product mounting surface 13, 23 external resin portion 14 case 14$s_1$, 14$s_2$ sidewall 15 flat spring 16 stay 22*g* belt groove 30 belt-like tightening member 31 belt portion 32 lock portion

The invention claimed is:

1. A reactor, comprising:

a magnetic core that includes a plurality of core pieces that are combined so as to form an annular shape;

a coil molded product that includes a coil that is formed of a helically wound wire and an internal resin portion that covers an outer periphery of the coil so as to maintain a shape of the coil; and an external resin portion that covers an outer periphery of an assembly of the magnetic core and the coil molded product, the coil molded product being disposed around an outer periphery of the magnetic core, wherein:

the magnetic core is fixed in the annular shape without use of adhesive, the coil is maintained in a state in which a free length of the coil is compressed by the resin portion, the coil includes a pair of coil elements formed of a helically wound single continuous wire, and the coil elements are formed so as to have a side-by-side structure in which the axis directions of the coil elements extend parallel to each other.

2. The reactor according to claim 1, further comprising:

a case that houses the assembly; and an elastic fixing member that is disposed in the case, the elastic fixing member pressing the magnetic core so as to maintain the magnetic core in the annular shape.

3. The reactor according to claim 1, further comprising:

a belt-like tightening member that maintains the magnetic core in the annular shape.

4. The reactor according claim 1, wherein the magnetic core includes the plurality of core pieces and at least one gap member, the plurality of core pieces being formed of a magnetic material and the at least one gap member being formed of a non-magnetic material, wherein, when the at least one gap member comprises a plurality of gap members, at least one of the plurality of gap members is formed of an elastic material.

* * * * *